US008623156B1

(12) United States Patent
Haines et al.

(10) Patent No.: US 8,623,156 B1
(45) Date of Patent: Jan. 7, 2014

(54) PYROPHORIC MATERIALS AND METHODS OF MAKING SAME

(75) Inventors: Christopher Haines, Union, NJ (US); Deepak Kapoor, Rockaway, NJ (US); Jan Puszynski, Rapid City, SD (US); Rajesh Shende, Rapid City, SD (US); Zac Doorenbos, Rapid City, SD (US); Lori Groven, Clarks Hill, IN (US)

(73) Assignees: The United States of America as represented by the Secretary of the Army, Washington, DC (US); South Dakota Board of Regents, Rapid City, SD (US)

( * ) Notice: Subject to any disclaimer, the term of this patent is extended or adjusted under 35 U.S.C. 154(b) by 83 days.

(21) Appl. No.: 13/091,385

(22) Filed: Apr. 21, 2011

(51) Int. Cl.

| | |
|---|---|
| ***C06B 45/00*** | (2006.01) |
| ***C06B 45/18*** | (2006.01) |
| ***C06B 45/30*** | (2006.01) |
| ***D03D 23/00*** | (2006.01) |
| ***D03D 43/00*** | (2006.01) |

(52) U.S. Cl.
USPC ..... 149/3; 149/2; 149/5; 149/108.2; 149/109.4

(58) Field of Classification Search
USPC ..... 149/3, 2, 5, 108.2, 109.4
See application file for complete search history.

(56) References Cited

U.S. PATENT DOCUMENTS

| | | | | |
|---|---|---|---|---|
| 6,916,389 | B2 * | 7/2005 | Pesiri et al. | 149/109.6 |
| 2011/0146518 | A1 * | 6/2011 | Liu et al. | 102/275.5 |
| 2012/0060984 | A1 * | 3/2012 | Gogotsi et al. | 149/35 |
| 2012/0192750 | A1 * | 8/2012 | Savrun et al. | 102/336 |

* cited by examiner

*Primary Examiner* — James McDonough
(74) *Attorney, Agent, or Firm* — Henry S. Goldfine

(57) ABSTRACT

An improved method for the production of pyrophoric materials which does not employ hot NaOH and produces pyrophoric materials on various types of ceramic, metal, nanomaterial substrates. The method impregnates the substrate materials with pyrophoric iron or other materials resulting in materials that are "tunable" with respect to its pyrophoric output as determined by its temperature, rise time sustenance etc through selective variation of particle size, morphology, and diluents or reactive materials.

1 Claim, 1 Drawing Sheet

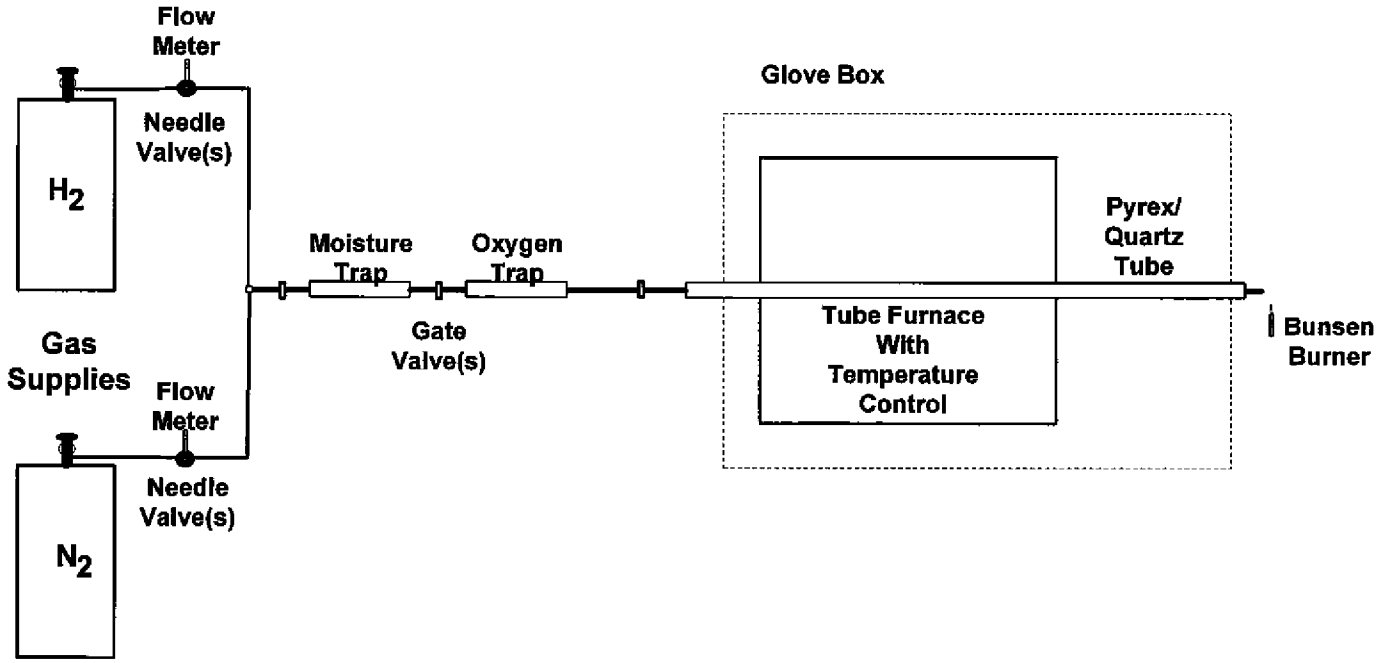
Flow Meter
Needle Valve(s)
$H_2$
Moisture Trap
Oxygen Trap
Gate Valve(s)
Glove Box
Pyrex/ Quartz Tube
Tube Furnace With Temperature Control
Bunsen Burner
Gas Supplies
Flow Meter
Needle Valve(s)
$N_2$

PYROPHORIC MATERIALS AND METHODS OF MAKING SAME

The inventions described herein may be manufactured, used and licensed by or for the U.S. Government for U.S. Government purposes.

FIELD OF THE DISCLOSURE

This disclosure relates generally to the field of pyrophoric materials and methods for their preparation. More particularly, it pertains to improved methods for preparing pyrophoric materials and improved pyrophoric materials employing carbon nanomaterials.

BACKGROUND OF THE DISCLOSURE

Pyrophoric materials have widespread military and industrial applicability. As a result a number of materials and methods for their preparation have been developed and described. One such method—described in U.S. Pat. No. 4,895,609—employs high temperature processing conditions and the use of a concentrated solution of NaOH to produce pyrophoric foils. As may be appreciated, high temperatures and concentrated NaOH are not particularly suitable for flexible pyrophoric substrates and may pose environmental issues as well.

United States Patent Application Publication No. US 2006/0042417 describes the preparation of porous pyrophoric iron using sol-gel methods which are employed to generate high surface area porous iron (III) oxide-based solutes. While the methods disclosed in this US 2006/0042417 application advantageously do not employ caustic NaOH, they unfortunately do not produce a porous Fe that is sufficiently pyrophoric for a variety of military and/or industrial applications.

Accordingly—given their military and/or industrial importance—new pyrophoric materials and/or improved methods for their preparation would represent a significant advance in the art.

SUMMARY OF THE DISCLOSURE

An advance in the art is made according to an aspect of the present disclosure directed to new pyrophoric materials and methods for their preparation. Advantageously, methods according to the present disclosure do not employ hot NaOH and the pyrophoric materials so produced are "tunable" with respect to pyrophoric output as determined by temperature, rise time and duration through selective variation of particle size(s), morphology, and diluents and/or reactive materials.

Viewed from a first aspect, the present disclosure is directed to preparative methods and pyrophoric materials comprising nanostructures and in particular carbon nanotubes, carbon nanofibers and ceramic nanofibers.

Viewed from another aspect, the present disclosure is directed to a method for the production of pyrophoric materials employing oxalate precursors.

Finally, viewed from a final aspect, the present disclosure is directed to a method for the production of pyrophoric materials employing SOL-GEL techniques/chemistries. In sharp contrast to prior-art SOL-GEL techniques which employ Fe(III) salts following typical hydrolysis and condensation reactions, SOL-GEL methods according to the present disclosure employ Fe(II) salts following an oxygen scavenging reaction from an alcohol. More particularly, alkyl halide elimination drives the production of oxolation complexes which advantageously do not produce polymorphic forms of iron thereby significantly improving product purity and pyrophoricity.

BRIEF DESCRIPTION OF THE DRAWING

A more complete understanding of the present disclosure may be realized by reference to the accompanying drawings in which:

FIG. 1 is a schematic diagram showing an apparatus for practicing the method according to the present disclosure;

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the disclosure.

With these principles in place, we may now describe the application of the present disclosure to the preparation of carbon nanotube, carbon nanofiber and ceramic nanofiber porous self-supporting substrates which serve as pyrophoric substrates. As we shall show and as will be readily appreciated by those skilled in the art, nanomaterials according to the present disclosure advantageously allow for the tunability of pyrophoric output in terms of temperature, rise time, sustenance, etc., by selective gradient or layering of substrate, metal oxide and/or fuel, adjustment of particle size, and addition of a diluents or other reactive material. Of further advantage, the preparation of these materials is particularly environmentally friendly as it may use water-based processing and readily available starting materials. Finally, the mechanical strength of porous, self-supporting, nanomaterial substrates may be tuned or adjusted by varying the thickness of carbon nanotube, nanofiber, or nanostructure layer(s).

Of particular interest, it is noted that carbon nanostructures as used herein are allotropes of carbon that may exhibit quite different structures. For example, one common allotropic form—fullerenes—generally include carbon atoms bonded together in spherical, tubular, or ellipsoidal formations. Carbon nanotubes (CNTs) are allotropes having cylindrical nanostructure. As noted above, CNTs are members of the fullerene structural family which also includes the spherical buckyballs. The ends of a nanotube may be capped with a hemisphere of the buckyball structure and CNTs may be categorized as single-walled nanotubes (SWNTs), doublewalled nanotubes (DWNTs), and multi-walled nanotubes (MWNTs). For our purposes, carbon nanostructures employed according to the present disclosure are somewhat interchangeable with one another and which one(s) chosen are application dependent.

Generally, the porous self-supporting substrates are fabricated and subsequently impregnated/coated with $Fe_2O_3$ nanoparticles which may advantageously exhibit varying particle size distributions and be combined with other fuels. More particularly, in one embodiment, carbon nanotubes (CNT's), carbon nanofibers (CNFs), and/or ceramic nanofibers or combinations thereof are dispersed in water along with a quantity of $Fe_2O_3$ and—in a preferred preparation—a quantity of suitable dispersant (i.e., Nanosperse AQ, Triton X-100, Coulter IC, SDS, etc). To this dispersed suspension may be added a quantity of an additional fuel, e.g. Al, Si, Mg, Ti, B, or alternatively their hydrides, e.g. $TiH_2$, etc.

The resulting dispersed suspension is filtered to recover the CNT/CNF/ceramic substrates which now include the $Fe_2O_3$ solids dispersed throughout the substrates. The recovered substrate(s) including the $Fe_2O_3$ are then washed with deionized $H_2O$.

The reduction of the $Fe_2O_3$ to a pyrophoric metal may now take place within the nanotube or nanofiber self-supporting porous substrate using $H_2$, $H_2/N_2$ gas at temperatures ranging from 300-600° C. More particularly, the substrates (including the Fe metal) are heated to a temperature of 300-600° C. in the presence of dry $H_2$. Advantageously, the dry $H_2$ may be mixed with dry $N_2$ or another dry inert gas. The reduced pyrophoric, self-supporting porous substrates are cooled to room temperature under a constant, dry, $H_2$, $N_2$ or $H_2/N_2$ gas flow. These cooled pyrophoric materials are then packaged under a dry, inert atmosphere.

More specifically, the carbon nanotube or carbon nanofiber suspension is prepared by addition of 0.060-0.100 grams CNTS or CNFs, and 2-4 drops Nanosperse AQ dispersant, to 60-100 mL reagent grade deionized water, followed by sonication.

An $Fe_2O_3$ suspension is prepared by addition of 100-200 mg $Fe_2O_3$ and 4 drops Nanosperse AQ dispersant, to 100 mL reagent grade deionized water, followed by sonication along with other reactive materials as specified above.

Free standing porous carbon nanotube or carbon nanofiber substrates are prepared by vacuum or pressure filtration of a carbon nanotube or carbon nanofiber suspension prepared as described above onto a 47 mm diameter 0.2 μm polyamide Whatman membrane.

The "infiltration" of $Fe_2O_3$ into the carbon nanotube or carbon nanofiber porous free standing substrate is accomplished by filtration of the $Fe_2O_3$ suspension onto the carbon nanotube or carbon nanofiber substrate. Dispersant removal is accomplished by repeated filtration washing with deionized water of the fabricated substrate.

In some configurations the procedure was modified in the following manner to result in varying thickness of substrates, graded substrates, additional fuel source presence, and/or composite substrates.

Those skilled in the art will appreciate that—in some cases—it may be desirable to produce layered or graded substrates. Advantageously, such fabrication may be performed by the alternate application of CNT or CNF and $Fe_2O_3$ nanoparticle suspensions (with or without additional fuel).

Furthermore, in some cases it may be desirable to produce a composite suspension comprising CNT or CNF and the $Fe_2O_3$ nanoparticles. In particular a fuel and oxidizer mixture may be employed in place or/in addition to the iron oxide to fabricate an electrically conductive reactive material. This could include but is not limited to materials such as $Al/Bi_2O_3$, Al/CuO, and $Al/MoO_3$.

We now describe the steps associated with, a SOL-GEL preparation of a pyrophoric iron composition from which a number of pyrophoric materials may be subsequently made. As known by those skilled in the art, a SOL-GEL process—also known as a chemical solution deposition—is a wet chemical technique used in the fields of materials science and ceramic engineering. SOL-GEL methods start from a chemical solution (SOL) that acts as a precursor for an integrated network (GEL) of either discrete particles or network polymers. Advantageously, SOL-GEL methods may be used for the preparation of metal oxides.

According to an aspect of the present disclosure, a Fe-based SOL is prepared and then used to form a GEL. As may be appreciated the SOL-GEL may be coated onto a substrate—for example a metal or other material (e.g. steels, glasses, ceramics, or any non-hydrophobic material, etc). This SOL-GEL coated substrate then undergoes calcination at approximately 400C and is reduced to a pyrophore in a dry $H_2$ environment. The pyrophoric material is then packaged and/or exposed to the general atmosphere for a pyrophoric response.

Those skilled in the art will readily understand that the present disclosure involves the preparation of pyrophoric, alpha-Fe (Alpha Iron). More particularly, the alpha-Fe is prepared by the reduction of $Fe_2O_3$ (iron oxide) in a reducing environment having 5-100 vol. % under constant flow of dry nitrogen gas in a tube reactor. The $Fe_2O_3$ is prepared using a SOL-GEL synthetic route using $FeCl_2*4H_2O$ (Iron (II) chloride also known as Ferrous Chloride) as the chemical precursor.

According to one aspect of the present disclosure, the SOL is prepared by dissolving $FeCl_2*4H_2O$ in ethanol (EtOH). To facilitate dissolution of the $FeCl_2*4H_2O$ in the ethanol, sonication is employed. In certain situations, it may be advantageous to include a block polymer, i.e., Brij-76, Pluronic 123, etc., or other surfactants/emulsifiers to the SOL at 0-30 wt. % concentration. Advantageously, the surfactant/emulsifier allows us the ability to tune the particle size, namely to synthesize smaller particles and effectively provides us with a "knob to turn". To this SOL, a quantity of propylene oxide (1,2-propylene oxide—PROPDX) is added in the range of 1-5 mol. % while maintaining a temperature of 25-40° C. thereby initiating the production of the SOL-GEL. Advantageously, and as will readily be appreciated by those skilled in the art, the preparatory materials required according to the present disclosure are readily available from any of a number of commercial chemical suppliers. Depending upon the particular concentrations of Fe, EtOH and PROPDX used, the reaction occurs between 2 minutes and 24 hours.

After addition of the PROPDX, a substrate is dip-coated into the SOL such that the SOL-GEL is formed/coated onto surfaces of the substrate. Specifically, the substrate (e.g. steel, ceramic, glass, alumina, etc) is immersed into the SOL after addition of the PROPDX and subsequently withdrawn after approximately 80% of the gel-formation time has elapsed (80% gelation time). Temperatures are generally kept at 25-40° C. however other temperatures/ranges may be employed depending upon the particular systems/substrates employed. Advantageously, the present disclosure is not limited to dip coating, as other methods, i.e., spin coating, or any of a variety of application methods (spraying, brushing, etc) known may be employed to apply the SOL to the substrate such that the SOL-GEL (FeOOH gel) forms thereon. Coated substrates (objects) may then preferably be aged for 0.5 to 24 hours prior to calcination.

Calcination of the FeOOH gel may be then performed on the gel itself, or a gel-coated substrate in a furnace in air atmosphere until dry. In a representative calcination, the substrate (FeOOH gel) is heated at a rate of substantially 0.5° C./min until 400-600° C. and then maintained at that temperature for 4-6 hours. As may be appreciated, the rate of heating may be varied to account for variations in substrates. Upon completion of the calcinations, a $Fe_3O_4$ powder or $Fe_2O_3$ coated substrate results.

The calcined $Fe_2O_3$ powder or $Fe_2O_3$ coated substrate is then reduced in a tube reactor, which as those skilled in the art will appreciate may be located in a horizontal split/tube furnace or equivalent. The $Fe_2O_3$ or substrates are placed in the furnace at a temperature of substantially 300-500° C. and reduced under 5-100 vol. % dry $H_2$ gas in ultra high pure dry $N_2$ gas for 5 to 10 minutes. Importantly, there should be no water or moisture or oxygen in the gas mixture during the reduction. After reduction the powder/substrates are cooled to room temperature under dry $N_2$ and subsequently packaged in a dry, inert and/or oxygen-free atmosphere.

Advantageously, the method of the present disclosure may be applied to the preparation of pyrophoric powders and/or films using an Fe-oxalate ($Fe[C_2O_4]$ Ferrous Oxalate or Iron (II) Oxalate) precursor. For this preparation, substantially 1.0 g of Fe-oxalate is loaded into an alumina boat type sample holder and placed in a quartz reactor. Samples are heated to 450-520° C. under a constant flow of dry, high-purity $N_2$ and maintained at this temperature for at least 5 minutes.

The heated sample is then exposed to a mixture of dry $N_2/H_2$ gas for a pre-determined period of time. The length of time may be extended for particularly thick samples, but for multiple samples exhibiting substantially the same thickness the time(s) will be substantially the same. The sample is then allowed to cool to room temperature while still under constant $N_2$ flow. The sample is then packaged as a pyrophoric powder in an $N_2$ or inert atmosphere.

Advantageously, pyrophoric films may be prepared from the Fe-oxalate starting materials as well. A Fe-oxalate film is prepared by dip-coating (or spraying or spin coating, etc) a metallic (e.g, steel, although most any metal may be used) foil with a Yttrium-SOL solution (Y-SOL) followed by application of a quantity of Fe-oxalate which adheres to the coated foil. The Fe-oxalate coated foil is then dip-coated into the Y-SOL solution and then treated as above by heating to substantially 400-600° C. in a dry $N_2$ atmosphere and then exposing the heated/coated foil to $H_2$ until the Fe is reduced. The resulting pyrophoric foil is allowed to cool and packaged in a dry, inert/N2 atmosphere.

The Y-SOL solution is prepared by dissolving a quantity of $YCl_3*7H_2O$ in methanol (preferably with sonication) along with a block polymer (Brij-76—20-30 wt. %) and a quantity of propylene oxide. And while the amounts may vary by SOL volume/concentration, it is preferably added dropwise until a total volume addition of 5-10 mL is reached.

A metallic foil is then dip-coated with the Y-SOL solution and dried at 100° C. for approximately 5 minutes or until dry. Next, a Fe(II)-oxalate slurry in acetone containing 2 wt. % carbon-dioxide-based polymer (QPAC) is prepared and applied to the dip-coated foil using—for example—known tape casting techniques. The film is allowed to dry, and this metallic foil, which is already coated with the Fe-oxalate—is again dip coated in the Y-SOL solution and dried at 90° C. although any temperature in the range of 60-100° C. is adequate with an adjustment made for longer dry times at lower temperatures in the range and shorter dry times at higher temperatures in the range. Higher temperatures are generally avoided as they may promote cracking of the pyrophoric materials.

Those skilled in the art will appreciate that Fe-oxalates may be prepared by any of a variety of known synthetic paths. For our purposes, Fe-oxalate powder was prepared using a solution-based controlled nucleation process. In this approach, $FeCl_2*2H_2O$ is dissolved in de-ionized water and the resulting solution heated to 60-70° C. with stirring. Slight excess to the stoichiometric amount of oxalic acid ($C_2H_2O_4*2H_2O$) was dissolved in de-ionized water and this solutions was added drop-wise to the $FeCl_2*2H_2O$ solution with stirring. After addition, the mixed solutions were maintained for 2 hours with constant stirring and then allowed to cool to room temperature (about 12 hours—undisturbed—no stirring) Upon cooling, two distinct solution layers form and the top-most layer is decanted, centrifuged, and any resulting precipitate recovered. This recovered precipitate is washed with de-ionized water and ethanol and dried at 95° C. for 1 hour.

With reference now to FIG. 1, there is shown a schematic block diagram of a representative apparatus which may be used for the reduction of iron and in particular the iron(II)-oxalate to the pyrophoric alpha-iron. Advantageously, the apparatus shown may be used for either the reduction of the iron(II) oxalate or iron tri-oxide to the alpha-iron. Generally, the apparatus includes flow-controllable sources of $N_2$ and $H_2$ gases, along with a moisture trap, and an $O_2$ trap positioned in a gas line between the gases and a tube furnace with temperature control. As shown in that FIG. 1, the tube furnace includes a pyrex/quartz reaction tube and the entire assembly is shown positioned within a glove box or other environmentally-controlled structure. Those skilled in the art will readily recognize that when scaled up to a production size, the glove box may be replaced with other environmental control structures suitable for that production scale.

Due to the nature of explosive nature of Hydrogen gas, it is useful to position Hydrogen sensors inside and outside the glove box. In a preferred embodiment, the hydrogen-nitrogen gas mixture may be burned outside the glove box.

At this point, while we have discussed and described the invention using some specific examples, those skilled in the art will recognize that our teachings are not so limited. For example, any pyrophoric metal and/or hydride may be employed with our nanostructures to create CNT or other pyrophoric materials. Metals of particular significance for these purposes include—but are not limited to—Mg, Ti, Zr, Co, and water stable metal hydrides (e.g. $TiH_2$, $AlH_3$) or even composite materials such as a metal-filled carbon nanotube or metal coated CNT. Accordingly, the invention should be only limited by the scope of the claims attached hereto.

The invention claimed is:

1. A pyrophoric material comprising:

a nanostructure substrate; and a quantity of pyrophoric material disposed thereupon;

wherein said pyrophoric material is selected from the group consisting of Fe, Mg, Ti, Zr, and metal hydrides.

* * * * *